United States Patent [19]

Morey et al.

[11] Patent Number: 4,701,225

[45] Date of Patent: Oct. 20, 1987

[54] PROCESS FOR THE HEAT TREATMENT OF A URANIUM ALLOY MEMBER

[75] Inventors: Jean-Michel Morey, Saint Seine l'Abbaye; Gilles Paradis, St. Apollinaire, both of France

[73] Assignee: Commissariat a l'Energie Atomique, Paris, France

[21] Appl. No.: 908,004

[22] Filed: Sep. 16, 1986

[30] Foreign Application Priority Data

Sep. 25, 1985 [FR] France ..... 85 14202

[51] Int. Cl.[4] ..... C21D 1/00

[52] U.S. Cl. ..... 148/132; 75/84.1 R; 252/625; 420/590; 420/3

[58] Field of Search ..... 148/132; 420/590; 75/122.5, 84.1; 252/625

[56] References Cited

U.S. PATENT DOCUMENTS

| | | | |
|---|---|---|---|
| 2,789,072 | 4/1957 | White | 148/132 |
| 2,830,896 | 4/1958 | Seybolt | 148/132 |
| 2,888,343 | 5/1959 | McGeary et al. | 148/132 |
| 2,926,113 | 2/1960 | McGeary et al. | 148/132 |
| 2,947,621 | 8/1960 | Foote | 148/132 |
| 3,969,160 | 7/1976 | Hemperly | 148/132 |
| 3,985,551 | 10/1976 | Powell et al. | 148/132 |

FOREIGN PATENT DOCUMENTS

| | | |
|---|---|---|
| 1417620 | 10/1965 | France . |
| 42035 | 7/1962 | Luxembourg . |

OTHER PUBLICATIONS

Chemical Abstracts, vol. 80, No. 12, 1974, p. 429, Ref. 65 820.

*Primary Examiner*—Stephen J. Lechert, Jr.
*Attorney, Agent, or Firm*—Oblon, Fisher, Spivak, McClelland & Maier

[57] ABSTRACT

The present invention relates to a process for the heat treatment of uranium alloy members.

This process comprises at least one $\gamma$-phase homogenization stage, followed by an induction heating stage and a hardening stage. The use of induction heating makes it possible to only heat the member and therefore modify the structure thereof at the surface. Thus, the hardness in the core and on the surface can optionally be adjusted by supplementary hardening and/or tempering stages.

Application to the production of protective materials.

10 Claims, No Drawings

PROCESS FOR THE HEAT TREATMENT OF A URANIUM ALLOY MEMBER

BACKGROUND OF THE INVENTION

The present invention relates to a process for the heat treatment of uranium alloy members making it possible to obtain different mechanical and structural properties between the core and surface of a member.

In certain cases, it may be of interest to obtain different mechanical properties between the surface and the core of a metal member, e.g. when producing protective materials.

SUMMARY OF THE INVENTION

The present invention more particularly applies to so-called age hardening uranium alloys, which are generally alloys of uranium with titanium, niobium or zirconium, the average content of addition elements being 0.5 to 6% by weight.

According to the main feature of the inventive process, it comprises the following successive stages:

(a) $\gamma$-phase homogenization, (b) induction heating, (c) hardening.

If it is wished to obtain a soft skin and a hard core, process also comprises a hardening stage (1) and then a tempering stage (2), the latter being performed after stage (a) and before stage (b).

The homogenization phase is performed at a temperature which varies as a function of the alloy, but generally exceeds 750° C. because, at said temperature, uranium is in the gamma phase and the addition elements are in solid solution. By hardening from this $\gamma$-phase, a martensitic phase is formed in which the addition elements are in super saturation. This martensitic phase is a variant of the $\alpha$-orthorhombic phase of uranium.

The higher the content of addition elements, the softer it is, the hardnesses generally being between 250 and 400 HV.

A subsequent tempering destabilizes the martensitic phase brings about the precipitation of hardening components. As a function of the type of alloy, the temperature and the tempering time, it is possible to obtain a hardness of 600 to 650 HV.

Induction heating makes it possible to only heat the member and therefore modify its structure over a given depth, which is dependent on the manner in which the heating operation is regulated. Thus, the depth heated by the current induced in the member is dependent on the frequency. For a frequency exceeding 300 kHz, the depth is less than 2 mm. For moderate frequencies, i.e. approximately 10 to 30 kHz, the depth is approximately 2 to 8 mm. At low frequencies, i.e. equal to or below 4 kHz, it exceeds 8 mm. This depth is also dependent on the characteristics of the material, including the electrical resistivity. Moreover, this method can be performed in an enclosure under vacuum or swept by a neutral gas, which is generally advantageous in view of the oxidizability of uranium.

If it is wished to obtain a member having a soft skin and a hard core, initially the homogenization, hardening and tempering stages described hereinbefore are performed. The member is then induction heated, in order to pass a surface strip into the $\gamma$-phase and redissolve the precipitates, but this only takes place on the surface. This heating is immediately followed by hardening, which brings about the martensitic transformation of the strip and therefore a surface area which is softer than the core. The width of the strip is dependent on the characteristics of the installation and particularly the characteristics of the induction heating current, the temperature reached on the surface and the redissolving kinetics of the precipitates in the $\gamma$-phase.

In order to better adjust the surface hardness, the process comprises a supplementary tempering stage (3) performed after the induction heating and hardening stages referred to hereinbefore. This tempering makes it possible to obtain the desired surface hardness. When proceeding in this way, it is obviously necessary to take account of the hardening effect of the second tempering operation on the core of the member when the first tempering treatment is performed.

When it is wished to obtain a hard skin and a soft core, a slow cooling stage (4) is performed from the $\gamma$-phase, i.e. after the homogenization stage and before the induction heating stage. Thus, by slow cooling, the gamma phase is broken down into two phases: $\gamma \rightarrow \alpha + U_xM_y$, in which $U_xM_y$ designates a phase rich in additional elements M. The hardness obtained is limited and is often less than the hardness of the corresponding alloy martensite. Following slow cooling, a martensite skin strip is formed by induction heating and surface hardening and a tempering stage (5) is performed, which does not modify the core structure.

DETAILED DESCRIPTION OF THE INVENTION

The invention can be better gathered from reading the following description given in an illustrative and non-limitative manner of a certain number of examples of the way in which the inventive process is performed. The tests described below were performed on uranium-titanium alloy members containing 0.75% by weight titanium.

EXAMPLE 1

This example aims at obtaining members which are hard in the core and soft on the surface. Firstly a homogenization treatment is performed at 850° C. for 1 hour, followed by hardening in water. This is followed by age hardening by tempering for $4\frac{1}{2}$ hours at 450° C. in a vacuum furnace.

The members are then heated by induction for 5 seconds at a frequency of 23.5 kHz in a closed container under argon sweeping or scavenging. This leads to a surface temperature of 1000° C., which corresponds to a heating rate of 200° C. per second. This was followed by hardening in water immediately at the end of heating.

This range made it possible to obtain members with a hardness gradient, the hardness being 375 HV in the skin over a 5 mm deep zone and 580 HV in the core.

EXAMPLE 2

In this example, the members underwent the same treatment as in Example 1, but the skin hardness was adjusted by a supplementary tempering treatment performed after the final hardening operation. This treatment does not significantly modify the core hardness.

By tempering for 4 hours at 400° C., a surface hardness of 420 HV was obtained and by tempering for 4 hours at 425° C. a surface hardness of 480 HV was obtained. In both cases, the core hardness remained 580 HV.

EXAMPLE 3

This example aimed at obtaining members which were hard on the surface and less hard in the core.

Firstly a homogenized treatment was carried out for one hour at 850° C., followed by controlled cooling in a vacuum furnace, the cooling rate being below 0.5° C. per second.

The members then underwent induction heating at a frequency of 23.5 kHz, which made it possible to attain a skin temperature of 1000° C. and a heating speed of 200° C. per second. The members were then hardened in water immediately following the heating operation. This was followed by a tempering treatment for four hours at temperatures between 350° and 450° C.

This range made it possible to obtain members with a hardness gradient. The core hardness was still below 320 HV, whilst the skin hardnesses ranged from 375 to 580 HV as a function of the chosen tempering temperature.

What is claimed is:

1. A process for the heat treatment of a uranium alloy member in order to obtain different properties between skin and core, wherein said process comprises the following successive stages:

(a) $\gamma$-phase homogenization, (b) induction heating, (c) hardening.

2. A process according to claim 1, making it possible to obtain a soft skin and a hard core, wherein it also comprises the following successive stages, performed after stage (a) and before stage (b):

(1) hardening, (2) tempering.

3. A process according to claim 2, wherein it comprises a supplementary tempering stage (3) performed after stage (c).

4. A process according to claim 1, making it possible to obtain a hard skin and a soft core, wherein it also comprises a slow cooling stage (4) performed after stage (a).

5. A process according to claim 4, wherein it comprises a supplementary tempering stage (5) performed after stage (c).

6. A process according to claim 1, wherein the hardening stage or stages are water hardening stages.

7. A process according to claim 1, wherein stage (b) is performed under vacuum.

8. A process according to claim 1, wherein stage (b) is performed with neutral gas scavening.

9. A process according to claim 1, wherein the member to be treated is made from an alloy of uranium with at least one of the elements titanium, niobium and zirconium.

10. A process according to claim 9, wherein the average content of addition elements in the member to be treated is between 0.5 and 6% by weight.

* * * * *